US009983499B2

(12) United States Patent
Tamaki et al.

(10) Patent No.: US 9,983,499 B2
(45) Date of Patent: May 29, 2018

(54) DISCHARGING MEMBER, AND CHARGE ELIMINATING DEVICE/IMAGE FORMING APPARATUS INCLUDING THE DISCHARGING MEMBER

(71) Applicant: KYOCERA Document Solutions Inc., Osaka (JP)

(72) Inventors: Kenichi Tamaki, Osaka (JP); Tamotsu Shimizu, Osaka (JP); Hiroka Itani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/464,860

(22) Filed: Mar. 21, 2017

(65) Prior Publication Data

US 2017/0277061 A1 Sep. 28, 2017

(30) Foreign Application Priority Data

Mar. 22, 2016 (JP) ..... 2016-056596

(51) Int. Cl.
*G03G 21/00* (2006.01)
*G03G 15/02* (2006.01)
*G03G 15/00* (2006.01)

(52) U.S. Cl.
CPC ..... *G03G 15/0241* (2013.01); *G03G 15/6552* (2013.01)

(58) Field of Classification Search
CPC ..... G03G 15/0241; G03G 15/6552
See application file for complete search history.

(56) References Cited

U.S. PATENT DOCUMENTS 4,657,372 A * 4/1987 Ikeda ..... G03G 15/22 399/113
5,032,875 A * 7/1991 Gooray ..... G03G 15/2003 399/328
2015/0198907 A1* 7/2015 Hino ..... G03G 15/0233 492/18

FOREIGN PATENT DOCUMENTS

JP 58171071 A * 10/1983 ..... G03G 15/0928
JP 60169869 A * 9/1985 ..... G03G 15/0928
JP 2007-292905 A 11/2007

* cited by examiner

*Primary Examiner* — Ryan Walsh
(74) *Attorney, Agent, or Firm* — Stein IP, LLC

(57) ABSTRACT

A discharging member includes an electrically conductive knit fabric, a support member, and a first magnet member. The conductive knit fabric is knitted into a cylindrical shape with use of yarn formed by twisting together a plurality of metal fibers. The support member is cylindrical shaped and inserted in the conductive knit fabric. The first magnet member is placed inside the support member. With the conductive knit fabric grounded or with a voltage applied to the conductive knit fabric, the discharging member is placed in noncontact with a discharged member in such a fashion that the first magnet member is opposed to the discharged member with the support member and the conductive knit fabric interposed therebetween.

11 Claims, 6 Drawing Sheets

DISCHARGING MEMBER, AND CHARGE ELIMINATING DEVICE/IMAGE FORMING APPARATUS INCLUDING THE DISCHARGING MEMBER

INCORPORATION BY REFERENCE

This application is based upon and claims the benefit of priority from the corresponding Japanese Patent Application No. 2016-56596 filed on Mar. 22, 2016, the entire contents of which are incorporated herein by reference.

BACKGROUND

The present disclosure relates to a discharging member for discharging photosensitive members, transfer sheets, fixing members and the like to be used in image forming apparatuses using an electrophotographic system, such as copiers, printers, facsimiles, and multifunction peripherals of their functions. The disclosure also relates to a charge eliminating device as well as an image forming apparatus including the discharging member.

In an image forming apparatus using electrophotographic process, electric charge remaining on a photosensitive drum (image carrier) after transfer of a toner image therefrom may cause occurrence of a memory image due to potential variations in subsequent image formation. Therefore, before execution of charging process, residual charge on the photosensitive drum is removed by a charge eliminating device, and thereafter the photosensitive drum is charged again. As a result of this, a surface of the photosensitive drum is uniformly charged, so that occurrence of memory images can be prevented. As a charge elimination method for residual charge, an optical charge elimination method for implementing charge elimination by photo-irradiation is commonly used.

However, by repetition of charge elimination by the optical charge elimination method, part of photocarriers produced inside the photosensitive layer due to light may remain or accumulate. In this case, there arises a fault of potential decreases on the surface of the photosensitive drum caused by photocarriers. Thus, there has been a desire for a charge elimination method other than the optical charge elimination method.

As a charge elimination method other than the optical charge elimination method, a noncontact charge elimination method making use of the self-discharge phenomenon has been proposed. The noncontact charge elimination method is to remove residual charge on an opposed member by making use of the self-discharge phenomenon from bump portions out of bumps and dips present on a discharging member to electrification charge present on a charge-elimination object article (discharged member). For example, there is known an image forming apparatus in which an electrically conductive part including woven fabric formed from conductive yarn is provided so as to be opposed to a recording medium placed on a conveyance path between a transfer unit and a fixing unit so that the recording medium, to which image transfer has been done by the transfer unit, is subjected to noncontact charge elimination.

Eliminating residual charge from on the surface of the photosensitive drum by using such a noncontact charge elimination method makes it unlikely that photocarriers remain inside the photosensitive layer, as would occur with the optical charge elimination method, so that decreases in the surface potential of the photosensitive drum can be suppressed. Further, since the charge eliminating roller and the photosensitive drum are out of contact with each other, there can be prevented flaws of the surface of the photosensitive drum as well as scraping of the photosensitive layer by the charge eliminating roller or contamination of the charge eliminating roller due to toner and external additives of toner sticking to the surface of the photosensitive drum. As a result, a stable charge elimination effect can be obtained over a long period.

SUMMARY

A discharging member in one aspect of the present disclosure includes an electrically conductive knit fabric, a support member, and a first magnet member. The conductive knit fabric is knitted into a cylindrical shape with use of yarn formed by twisting together a plurality of metal fibers. The support member is cylindrical shaped and inserted in the conductive knit fabric. The first magnet member is placed inside the support member. With the conductive knit fabric grounded or with a voltage applied to the conductive knit fabric, the discharging member is placed in noncontact with a discharged member to be discharged in such a fashion that the first magnet member is opposed to the discharged member with the support member and the conductive knit fabric interposed therebetween.

Further objects of this disclosure and concrete advantages obtained by the disclosure will be more apparent from the following description of embodiments thereof.

DETAILED DESCRIPTION

Figure 1:
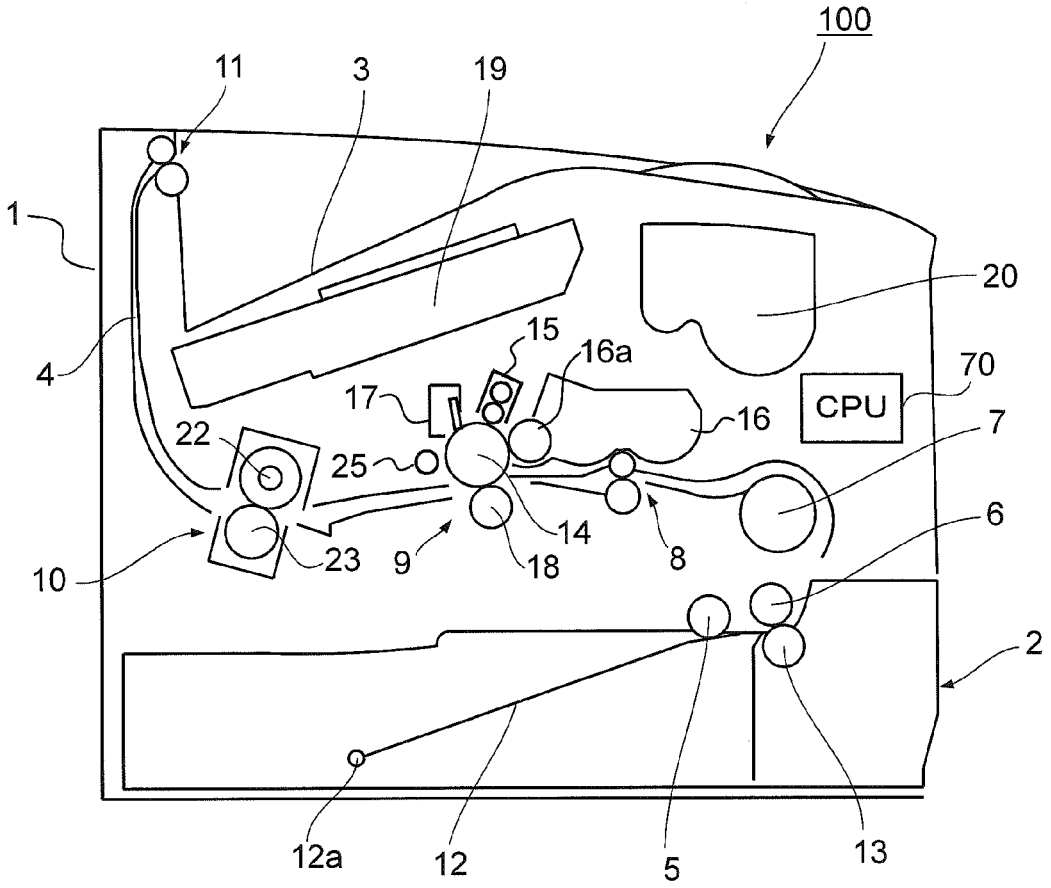
FIG. 1 is a schematic view showing an overall configuration of an image forming apparatus according to a first embodiment of the disclosure.

Hereinbelow, embodiments of the disclosure will be described with reference to the accompanying drawings. FIG. 1 is a schematic view showing an overall configuration of an image forming apparatus 100 according to a first embodiment of the disclosure, where the right side is regarded as the front side of the image forming apparatus 100. As shown in FIG. 1, the image forming apparatus 100 (monochromatic printer in this case) includes, in lower part of its apparatus body 1, a sheet feed cassette 2 for storing therein stacked paper sheets. Above the sheet feed cassette 2, a sheet conveyance path 4 is formed so as to extend generally horizontally from front to back of the apparatus body 1 and further extend upward, reaching a sheet discharge part 3 formed on top of the apparatus body 1. Along the sheet conveyance path 4, provided in order from the upstream side are a pickup roller 5, a feed roller 6, an intermediate conveyance roller 7, a registration roller pair 8, an image forming part 9, a fixing unit 10, and a discharge roller pair 11. Further provided inside the image forming apparatus 100 is a control unit (CPU) 70 for controlling operations of the individual rollers, the image forming part 9, the fixing unit 10, and the like.

The sheet feed cassette 2 is equipped with a sheet loading plate 12 which is supported on a pivotal fulcrum 12*a* provided at a rear end portion in a sheet conveyance direction so as to be pivotable against the sheet feed cassette 2. A paper sheet (recording medium) loaded on the sheet loading plate 12 is to be pressed by the pickup roller 5. On the forward side of the sheet feed cassette 2, a retard roller 13 is provided so as to be in pressure contact with the feed roller 6. When plural sheets are fed at one time by the pickup roller 5, the sheets are disentangled by the feed roller 6 and the retard roller 13 so that one sheet of the uppermost place alone is conveyed.

Then, the sheet separated by the feed roller 6 and the retard roller 13 is changed in conveyance direction, rearward of the apparatus, by the intermediate conveyance roller 7 so as to be conveyed to the registration roller pair 8. The sheet is adjusted for timing by the registration roller pair 8, thus fed to the image forming part 9.

The image forming part 9 is to form a specified toner image on the sheet by electrophotographic process. The image forming part 9 is made up of: a photosensitive drum 14 as an image carrier shaft-supported so as to be rotatable clockwise as viewed in FIG. 1; a charging unit 15, a developing unit 16, a charge eliminating roller 25 and a cleaning unit 17, these four members being placed around the photosensitive drum 14; a transfer roller 18 placed so as to be opposed to the photosensitive drum 14 with the sheet conveyance path 4 interposed therebetween; and an LSU (Laser Scanning Unit) 19 placed above the photosensitive drum 14. Above the developing unit 16, a toner container 20 for supplying toner to the developing unit 16 is placed.

In this embodiment, the photosensitive drum 14 is an organic photoconductor (OPC), in which an organic photosensitive layer is stacked on an electrically conductive base body (cylindrical member) of aluminum or the like.

The charging unit 15 includes, in its housing, a charging roller 41 (see FIG. 2) for making contact with the photosensitive drum 14 to apply a charging bias to the drum surface, and a charging-roller cleaning brush for cleaning the charging roller 41. The charging roller 41 is formed from electrically conductive rubber and placed so as to be in contact with the photosensitive drum 14.

The developing unit 16 feeds toner to an electrostatic latent image formed on the photosensitive drum 14 by a developing roller 16*a*. Feed of toner to the developing unit 16 is performed by the toner container 20. In addition, in this case, a one-component developer (hereinafter, referred to simply as toner) composed of a magnetic toner component alone is stored in the developing unit 16.

The cleaning unit 17 includes a cleaning blade 47 (see FIG. 2) and a toner collecting roller (not shown). For example, a blade made from polyurethane elastomer having a JIS hardness of 78° is used as the cleaning blade 47, which is set up at a specified angle to a tangential direction of the photosensitive member as measured at its contact point. Material and hardness of the cleaning blade 47, as well as its dimensions, biting extent and pressure-contact force against the photosensitive drum 14, and the like are set, as appropriate, pursuant to the specifications of the photosensitive drum 14. It is noted that the term 'JIS hardness' refers to the hardness defined by the JIS (Japanese Industrial Standards).

The transfer roller 18 transfers a toner image formed on the surface of the photosensitive drum 14 onto a sheet conveyed up along the sheet conveyance path 4 without disturbing the toner image. A transfer-bias power source and a bias control circuit (neither shown) for applying a transfer bias of a polarity reverse to the toner is connected to the transfer roller 18.

When image data is inputted from a host device such as a personal computer, the image forming apparatus 100 first makes the surface of the photosensitive drum 14 uniformly charged by the charging unit 15. Next, an electrostatic latent image based on the inputted image data is formed on the photosensitive drum 14 by a laser beam derived from the LSU 19. Further, toner is applied to the electrostatic latent image by the developing unit 16 so that a toner image is formed on the surface of the photosensitive drum 14. The toner image formed on the surface of the photosensitive drum 14 is transferred by the transfer roller 18 onto a sheet fed to a nip part (transfer position) between the photosensitive drum 14 and the transfer roller 18.

The sheet with the toner image transferred thereon is separated from the photosensitive drum 14 and conveyed toward the fixing unit 10. The fixing unit 10 is placed on a downstream side of the image forming part 9 in the sheet conveyance direction. The sheet, on which the toner image has been transferred at the image forming part 9, is heated and pressurized by a heating roller 22 included in the fixing unit 10 and a pressure roller 23 in pressure contact with the heating roller 22, respectively, by which the toner image transferred on the sheet is fixed. Then, the sheet having been subjected to image formation in the image forming part 9 and the fixing unit 10 is discharged to the sheet discharge part 3 by the discharge roller pair 11.

After the transfer process, residual toner on the surface of the photosensitive drum 14 is removed by the cleaning unit 17, and residual charge on the surface of the photosensitive drum 14 is eliminated by the charge eliminating roller 25. Then, the photosensitive drum 14 is recharged by the charging unit 15, followed by execution of image formation in the same way.

Figure 2:
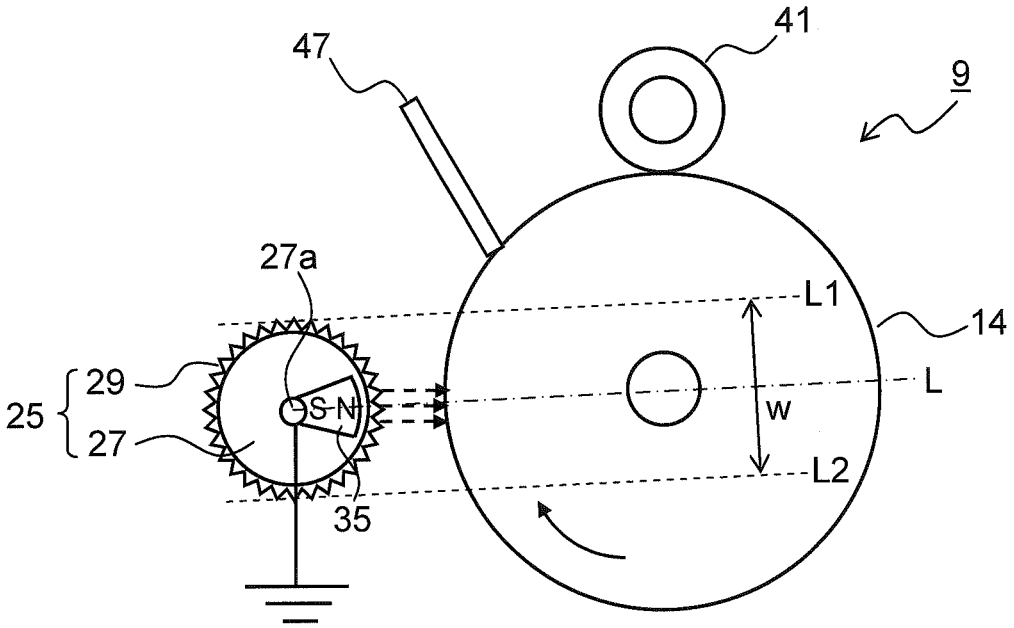
FIG. 2 is a partial enlarged view of an image forming part in the image forming apparatus of the first embodiment.

FIG. 2 is a partial enlarged view of a vicinity of the image forming part 9 in the image forming apparatus 100 of the first embodiment. In FIG. 2, for explanation's sake, only the photosensitive drum 14, the charging roller 41, the cleaning blade 47 and the charge eliminating roller 25 are shown, whereas the developing unit 16, the transfer roller 18 and the like are omitted in depiction.

As the photosensitive drum 14 is rotated clockwise in FIG. 2, the charging roller 41 in contact with the surface of the photosensitive drum 14 is subordinately rotated counterclockwise in FIG. 2. In this state, applying a specified voltage to the charging roller 41 causes the surface of the photosensitive drum 14 to be uniformly charged. Also, along with the rotation of the charging roller 41, a charging-roller cleaning brush in contact with the charging roller 41 is subordinately rotated clockwise in FIG. 2, eliminating foreign matters deposited on the surface of the charging roller 41.

On the upstream side of the charging roller 41 in the rotational direction of the photosensitive drum 14, the cleaning blade 47 is fixed so as to be in contact with the surface of the photosensitive drum 14.

On the upstream side of the cleaning blade 47 in the rotational direction of the photosensitive drum 14, the charge eliminating roller 25 is placed in noncontact with the surface of the photosensitive drum 14. The charge eliminating roller 25 includes a cylindrical-shaped support member 27, an electrically conductive knit fabric 29 fitted on an outer circumferential surface of the support member 27, and a charge eliminating roller-side magnet 35 placed inside the support member 27. The charge eliminating roller-side magnet 35 is placed with its one magnetic pole (N pole in this case) opposed to the photosensitive drum 14.

Although the charge eliminating roller 25 is placed on the upstream side of the cleaning blade 47 in the rotational direction of the photosensitive drum 14 in the case of FIG. 2, yet the charge eliminating roller 25 may also be placed on the downstream side of the cleaning blade 47 only if it is on the upstream side of the charging roller 41.

Figure 3:
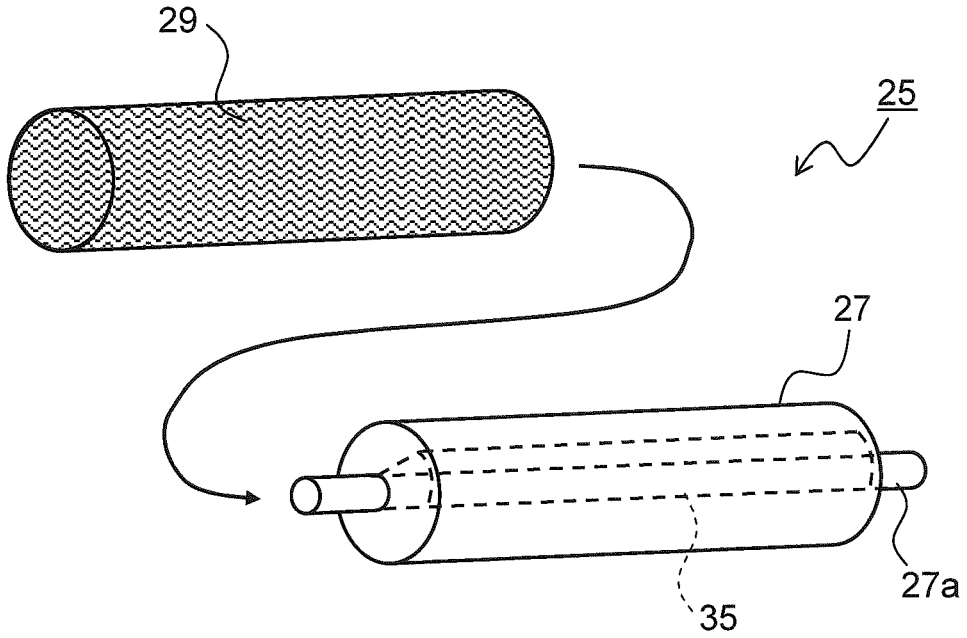
FIG. 3 is an exploded perspective view of a charge eliminating roller to be used in the image forming apparatus of the first embodiment.

FIG. 3 is an exploded perspective view of the charge eliminating roller 25 to be used in the image forming apparatus 100 of the first embodiment. The support member 27 is made from metal and has support shafts 27*a* formed at longitudinal both end portions. As shown in FIG. 2, the support shafts 27*a* are grounded to the ground. The conductive knit fabric 29 is a knit fabric knitted into a cylindrical shape with use of yarn formed by twisting together a plurality of metal fibers. For example, stainless steel fiber is used as the metal fiber.

Herein, the term 'knit fabric' refers to a fabric which is formed by 'mesh-by-mesh' formation process with meshes formed from a single yarn, the knit fabric being clearly distinguished from 'woven fabric' which has a structure with a multiplicity of warp and weft crossing each other and which is formed by 'stage-by-stage' formation process.

The conductive knit fabric 29, having stretchability, is formed preparatorily with its inner diameter smaller than the outer diameter of the support member 27. In assembling of the charge eliminating roller 25, as shown in FIG. 3, the charge eliminating roller-side magnet 35 is first fixedly set inside the support member 27. Then, while the conductive knit fabric 29 is being stretched in its radial direction, the support member 27 is inserted more and more inside the conductive knit fabric 29, by which the conductive knit fabric 29 is fitted on the outer circumferential surface of the support member 27. The conductive knit fabric 29 is retained on the outer circumferential surface of the support member 27 by restoring force (shrinkage force).

Figure 4:
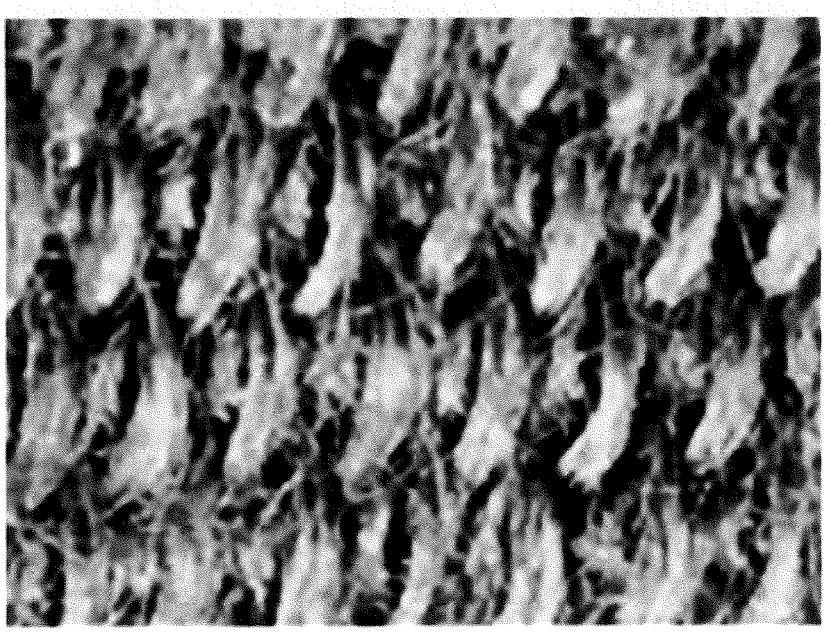
FIG. 4 is an enlarged photograph of a surface of a conductive knit fabric.

FIG. 4 is an enlarged photograph of a surface of the conductive knit fabric 29. As shown in FIG. 4, a multiplicity of metal fibers are protruded on the surface of the conductive knit fabric 29. Between the metal fibers and the surface of the photosensitive drum 14, corona discharge occurs so that ions of a reverse polarity to the surface charge of the photosensitive drum 14 are released from the metal fibers, thereby eliminating residual charge on the surface of the photosensitive drum 14.

Since the charge eliminating roller 25 to be used in the image forming apparatus 100 of this embodiment utilizes the self-discharge phenomenon against the photosensitive drum 14 to eliminate the residual charge on the surface of the photosensitive drum 14, there occurs no remaining of photocarriers inside the photosensitive layer as would be seen in the optical charge elimination method. By virtue of this, the fault of decreases in surface potential of the photosensitive drum 14 caused by the remaining of the photocarriers can be solved.

Also in this embodiment, by magnetic lines of force (indicated by broken-line arrows in FIG. 2) produced from the magnetic pole of the charge eliminating roller-side magnet 35, orientations of metal fibers protruded from the conductive knit fabric 29 making up the charge eliminating roller 25 are concentrated to within an oppositional region (charge-elimination nip width) between the photosensitive drum 14 and the charge eliminating roller 25 along the magnetic lines of force. As a result of this, the density of discharge points (fiber tips) of the conductive knit fabric 29 is increased, so that the charge elimination effect is improved. It is noted that the charge-elimination nip width refers to a width w between two tangential lines L1, L2 on the outer circumferential surface of the charge eliminating roller 25 parallel to a straight line L passing through a rotational center of the photosensitive drum 14 and a center of the support shafts 27*a* of the charge eliminating roller 25.

Also, since the charge eliminating roller 25 is capable of eliminating charge in noncontact with the photosensitive drum 14, there can be prevented flaws of the surface of the photosensitive drum 14 as well as scraping of the photosensitive layer or contamination of the charge eliminating roller 25 due to toner and external additives of toner. Thus, a stable charge elimination effect can be maintained over a long period.

Since the conductive knit fabric 29 to be used in the charge eliminating roller 25 is formed by knitting yarn made of twisted metal fibers, its specific surface area is considerably larger as compared with, for example, woven fabric of metal fibers. As a result, discharge points are increased and so the corona discharge can be generated with high efficiency, making it possible to fulfill high-efficiency charge elimination. Also, indeed the lower the fineness of metal fibers to be used for the yarn becomes (the thinner the fibers become), the more the discharge points increase, but excessively thin fibers cause the charge eliminating roller 25 to become lower in durability. The diameter of the metal fibers is preferably within a range of 8 μm to 20 μm.

Further, the conductive knit fabric 29, with its stretchability utilized, can be fixed to the support member 27 without using adhesive or the like. In this case, preparatorily setting the outer circumferential surface of the support member 27 as a rough surface allows the conductive knit fabric 29 to be further improved in terms of retainability performance.

Figure 5:
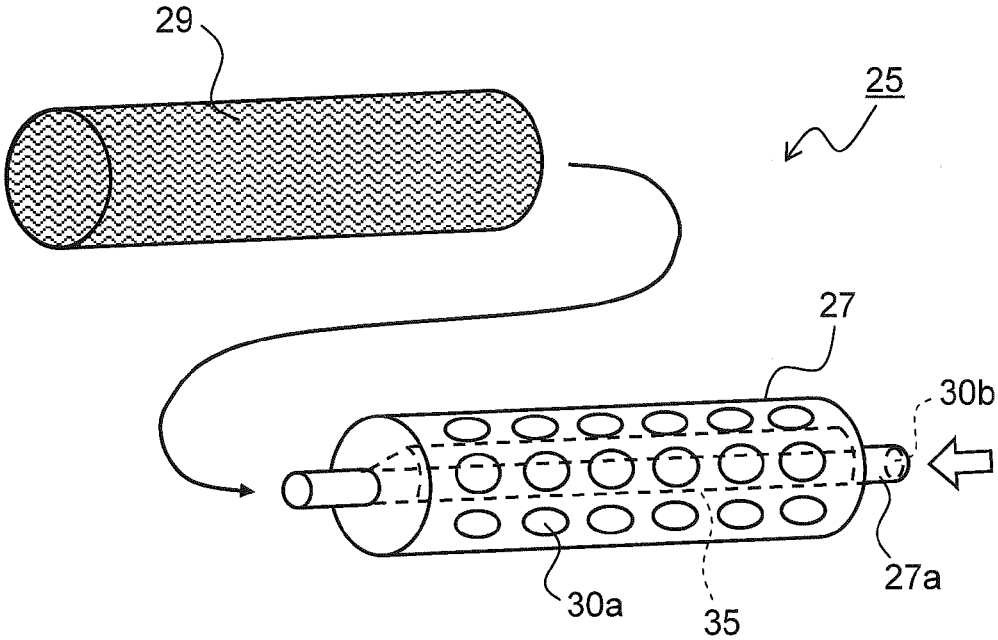
FIG. 5 is an exploded perspective view showing a modification of the charge eliminating roller to be used in the image forming apparatus of the first embodiment.

FIG. 5 is an exploded perspective view showing a modification of the charge eliminating roller 25 to be used in the image forming apparatus 100 of the first embodiment. In the modification shown in FIG. 5, the support member 27 is hollow shaped and has a multiplicity of through holes 30*a* formed in its outer circumferential surface. Then, at least one end of the support shafts 27*a* (right-side support shaft 27*a* in FIG. 5) and the interior of the support member 27 are communicated with each other to form an airflow inlet hole 30*b*, which allows an air flow to be delivered from the support shaft 27*a* into the support member 27.

The air flow delivered into the support member 27 is blown through the through holes 30*a* to the conductive knit fabric 29 fitted on the outer circumferential surface of the support member 27, passing through clearances of the conductive knit fabric 29 so as to be discharged outside. In this case, since dust and dirt residing at clearances of the conductive knit fabric 29 are removed by the air flow, decreases in the charge elimination performance due to contamination of the conductive knit fabric 29 can be suppressed. This modification utilizes a feature of the conductive knit fabric 29, i.e. excellent air permeability, whereas similar effects could not be expected with use of lower-permeability woven fabric or felt, nonwoven fabric, and the like.

Figure 6:
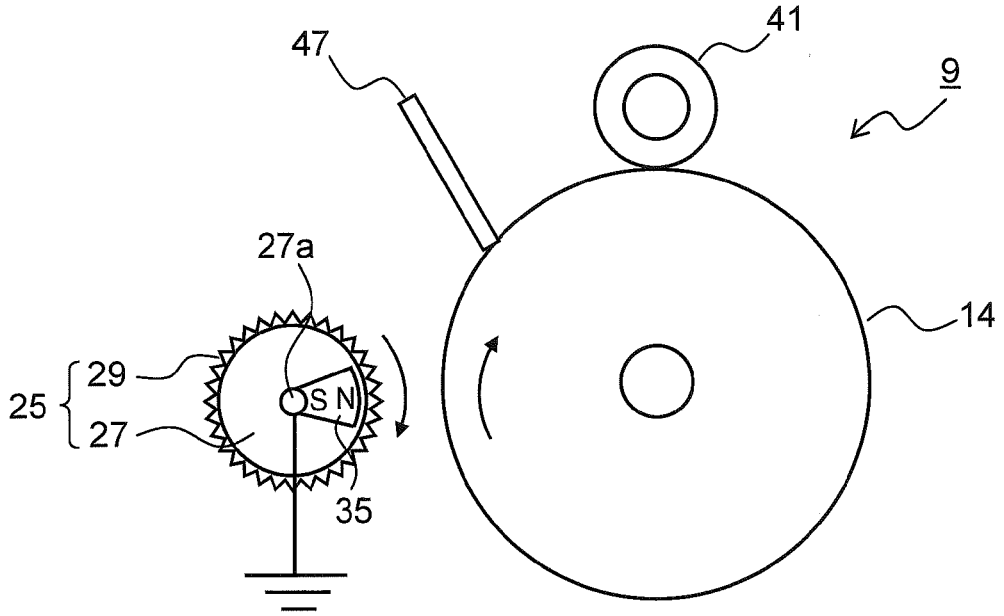
FIG. 6 is a partial enlarged view of a vicinity of an image forming part in an image forming apparatus according to a second embodiment of the disclosure.

FIG. 6 is a partial enlarged view of a vicinity of an image forming part 9 in an image forming apparatus 100 according to a second embodiment of the disclosure. As with FIG. 2, also in the following FIGS. 6 to 10, only the photosensitive drum 14, the charging roller 41, the cleaning blade 47, and the charge eliminating roller 25 are shown.

In this embodiment, the support member 27 and the support shaft 27*a*, which constitute the charge eliminating roller 25, are independent members, where the support shaft 27*a* is unrotatably fixed inside the support member 27 together with the charge eliminating roller-side magnet 35. The support member 27 is supported so as to be rotatable about the support shaft 27*a*. As a result of this, the charge eliminating roller 25 is rotated in a counter direction to the photosensitive drum 14 at its opposed surface to the photosensitive drum 14.

As the charge eliminating roller 25 is rotated in the counter direction to the photosensitive drum 14, the discharge points of the conductive knit fabric 29 passing through the opposed portion to the photosensitive drum 14 are increased. As a result, the charge elimination efficiency is improved as compared with cases in which the charge eliminating roller 25 is stopped. In addition, in the case of a high process speed of the image forming apparatus 100 (linear velocity of the photosensitive drum 14), the linear velocity ratio (number of rotations) of the charge eliminating roller 25 to the photosensitive drum 14 is raised and the circumferential length of the conductive knit fabric 29 passing through the opposed portion to the photosensitive drum 14 is elongated. As a result of this, the charge elimination efficiency can be more improved by further increasing the discharge points.

Figure 7:
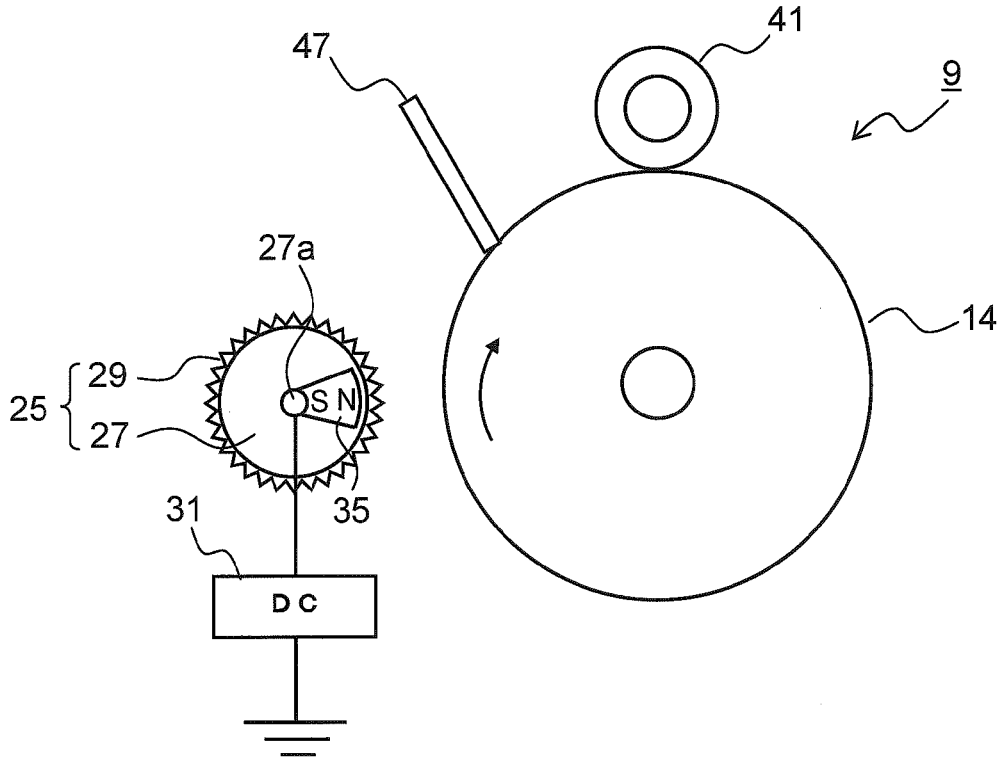
FIG. 7 is a partial enlarged view of a vicinity of an image forming part in an image forming apparatus 100 according to a third embodiment of the disclosure.

FIG. 7 is a partial enlarged view of a vicinity of an image forming part 9 in an image forming apparatus 100 according to a third embodiment of the disclosure. In this embodiment, a DC power source 31 is connected to the support shaft 27*a* of the support member 27 forming part of the charge eliminating roller 25, so that a DC voltage can be applied to the charge eliminating roller 25.

Applying to the charge eliminating roller 25 a DC voltage of a reverse polarity (negative polarity in this case) to the surface potential of the photosensitive drum 14 (positive polarity in this case) makes it possible to eliminate residual charge on the surface of the photosensitive drum 14 more effectively.

Although similar effects can be obtained even with an AC voltage applied to the charge eliminating roller 25, yet it is preferable to apply a DC voltage because of a possibility that a problem of resonance frequency with an AC voltage applied to the developing roller 16*a* of the developing unit 16 (see FIG. 1) or other problems may occur. Also, when the DC voltage applied to the charge eliminating roller 25 is made variable, it is made possible to control the charge elimination effect for residual charge on the surface of the photosensitive drum 14.

Figure 8:
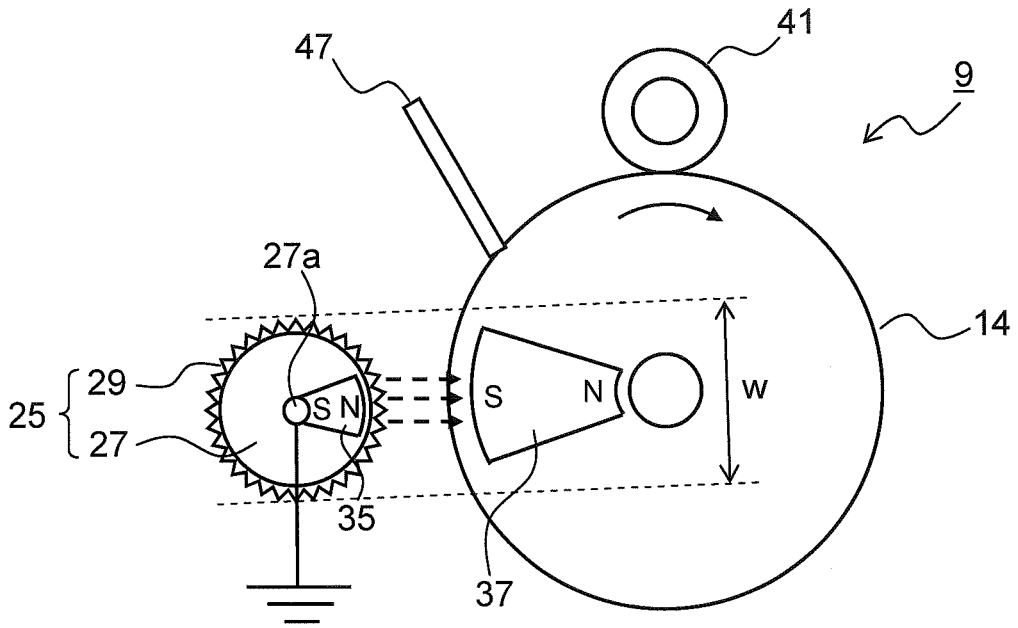
FIG. 8 is a partial enlarged view of a vicinity of an image forming part in an image forming apparatus according to a fourth embodiment of the disclosure.

FIG. 8 is a partial enlarged view of a vicinity of an image forming part 9 in an image forming apparatus 100 according to a fourth embodiment of the disclosure. In this embodiment, a drum-side magnet 37 is placed inside the photosensitive drum 14 so that a magnetic pole (S pole in this case) of the drum-side magnet 37 is opposed to a magnetic pole (N pole) of the charge eliminating roller-side magnet 35. The rest of construction is similar to that of the first embodiment shown in FIG. 2.

With the constitution of this embodiment, since magnetic lines of force (indicated by broken-line arrows in FIG. 8) produced from the magnetic pole of the charge eliminating roller-side magnet 35 are directed toward the magnetic pole of the drum-side magnet 37, orientations of metal fibers protruded from the conductive knit fabric 29 forming part of the charge eliminating roller 25 are concentrated to within an oppositional region (charge-elimination nip width w) between the photosensitive drum 14 and the charge eliminating roller 25 along the magnetic lines of force. As a result of this, the discharge points (fiber tips) of the conductive knit fabric 29 are increased, so that the charge elimination effect is improved.

Figure 9:
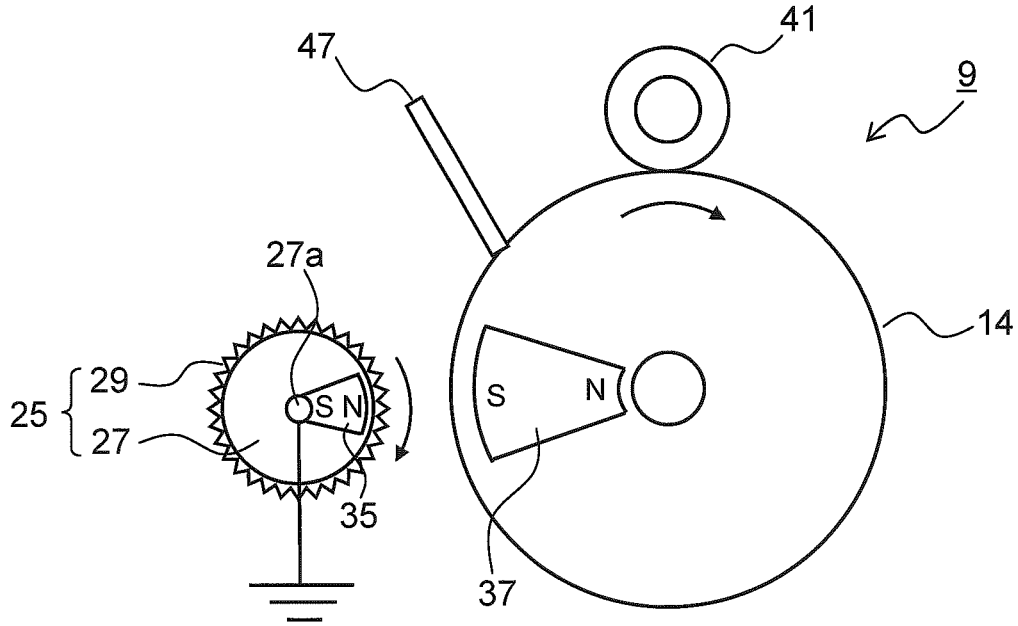
FIG. 9 is a partial enlarged view of a vicinity of an image forming part in an image forming apparatus according to a fifth embodiment of the disclosure.

FIG. 9 is a partial enlarged view of a vicinity of an image forming part 9 in an image forming apparatus 100 according to a fifth embodiment of the disclosure. In this embodiment, in addition to the makeup of the fourth embodiment in which the charge eliminating roller-side magnet 35 is placed inside the charge eliminating roller 25 while the drum-side magnet 37 is placed inside the photosensitive drum 14, it is also arranged that, as in the second embodiment, the charge eliminating roller 25 is rotated in a counter direction to the photosensitive drum 14 at the opposed surface to the photosensitive drum 14.

With the constitution of this embodiment, since magnetic lines of force produced from the magnetic pole of the charge eliminating roller-side magnet 35 are intensified by the drum-side magnet 37, orientations of metal fibers protruded from the conductive knit fabric 29 are concentrated to within the charge-elimination nip width w along the magnetic lines of force. As a result of this, the discharge points of the conductive knit fabric 29 are increased, so that the charge elimination effect is improved, as in the fourth embodiment.

As the charge eliminating roller 25 is rotated in the counter direction to the photosensitive drum 14, the discharge points of the conductive knit fabric 29 passing through the opposed portion to the photosensitive drum 14 are also increased. As a result, the charge elimination efficiency is improved as compared with cases in which the charge eliminating roller 25 is stopped. In addition, in the case of a high process speed of the image forming apparatus 100 (linear velocity of the photosensitive drum 14), the linear velocity ratio (number of rotations) of the charge eliminating roller 25 to the photosensitive drum 14 is raised and the circumferential length of the conductive knit fabric 29 passing through the opposed portion to the photosensitive drum 14 is elongated. As a result of this, the charge elimination efficiency can be more improved by further increasing the discharge points.

Figure 10:
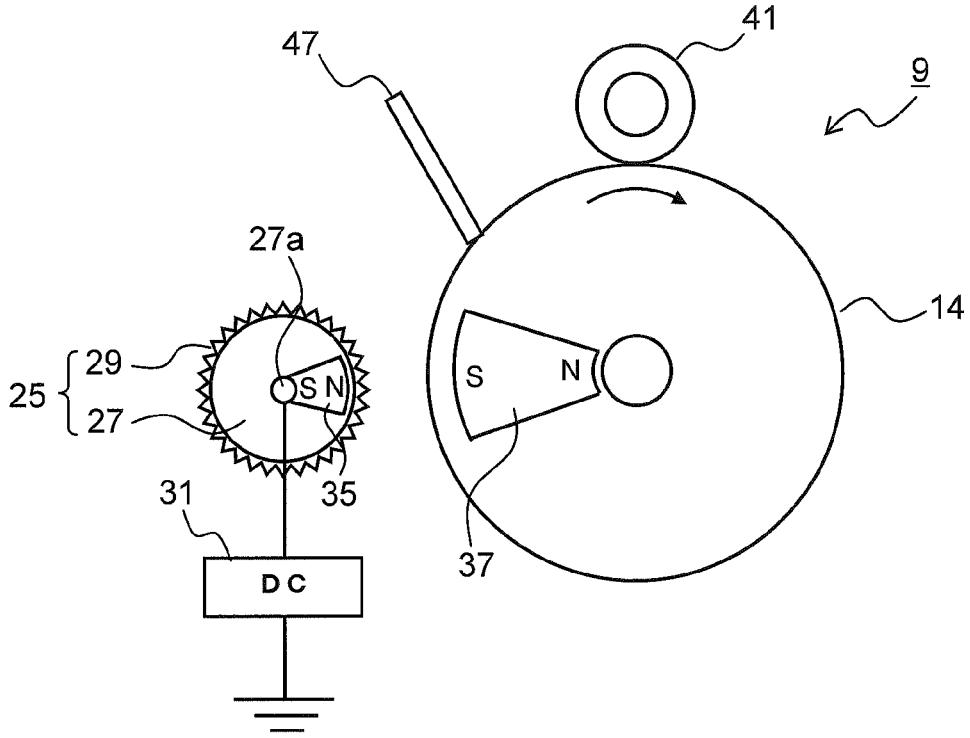
FIG. 10 is a partial enlarged view of a vicinity of an image forming part in an image forming apparatus according to a sixth embodiment of the disclosure.

FIG. 10 is a partial enlarged view of a vicinity of an image forming part 9 in an image forming apparatus 100 according to a sixth embodiment of the disclosure. In this embodiment, in addition to the makeup of the fourth embodiment in which the charge eliminating roller-side magnet 35 is placed inside the charge eliminating roller 25 while the drum-side magnet 37 is placed inside the photosensitive drum 14, it is also arranged that a DC power source 31 is connected to the support shaft 27*a* of the support member 27 forming part of the charge eliminating roller 25, so that a DC voltage can be applied to the charge eliminating roller 25.

With the constitution of this embodiment, applying to the charge eliminating roller 25 a DC voltage of a reverse polarity (negative polarity in this case) to the surface potential (positive polarity in this case) of the photosensitive drum 14 makes it possible to eliminate residual charge on the surface of the photosensitive drum 14 more effectively as compared with the fourth embodiment. Also, when the DC voltage applied to the charge eliminating roller 25 is made variable, it is made possible to control the charge elimination effect for residual charge on the surface of the photosensitive drum 14.

In FIGS. 8 to 10, the magnetic pole (N pole) of the charge eliminating roller-side magnet 35 and the magnetic pole (S pole) of the drum-side magnet 37 are set heteropolar to each other. However, the magnetic pole of the charge eliminating roller-side magnet 35 and the magnetic pole of the drum-side magnet 37 may be set homopolar to each other.

When the magnetic pole of the charge eliminating roller-side magnet 35 and the magnetic pole of the drum-side magnet 37 are set homopolar to each other, there arises a repulsive magnetic field between the charge eliminating roller-side magnet 35 and the drum-side magnet 37. As a result, magnetic lines of force produced from the magnetic pole of the charge eliminating roller-side magnet 35 are directed outward of the charge-elimination nip width w, so that the charge elimination effect is enhanced in vicinities of both end portions than in central portion of the charge-elimination nip width w.

In addition, this disclosure is not limited only to the above-described embodiments and may be changed and modified in various ways unless those changes and modifications depart from the gist of the disclosure. For example, configurations in combinations among the individual embodiments may of course be included in this disclosure. Further, instead of the charging unit 15 of the contact charging method using the charging roller 41 as shown in the foregoing embodiments, a charging unit of the corona charging method including a corona wire and a grid may be used. Also instead of the developing unit 16 of the one-component developer type, a developing unit of the two-component developer type using a two-component developer containing toner and magnetic carrier may be used.

The foregoing embodiments have been described on an example in which the charge eliminating roller 25 for eliminating residual charge on the photosensitive drum 14 is given by applying therefor a discharging member made up by fitting the conductive knit fabric 29 to the cylindrical-shaped support member 27 and placing the charge eliminating roller-side magnet 35 (magnet member) inside the support member 27. However, the discharging member using the support member 27, the conductive knit fabric 29 and the magnet member is applicable not only for the charge eliminating roller 25 but also for charge elimination of transfer sheets, charge elimination of the fixing roller, and the like. Furthermore, depending on the voltage to be applied, the discharging member is applicable even for charging of the photosensitive drum 14, collection of carrier deposited on the photosensitive drum 14, and enhancement of the charging level of toner developed on the photosensitive drum 14.

Further, the image forming apparatus of this disclosure, without being limited to such monochromatic printers as shown in FIG. 1, may be any of other image forming apparatuses such as monochromatic and color copiers, digital multifunction peripherals, color printers, and facsimiles. Hereinbelow, effects of this disclosure will be explained even more concretely by way of Examples.

Example 1

Charge elimination performance of the charge eliminating roller 25 was evaluated with use of the image forming apparatuses 100 of the first to third embodiments (Disclosures 1 to 5) including the image forming parts 9 as shown in FIG. 2 and FIGS. 6 and 7. With regard to the charge elimination performance, a halftone image at a print coverage rate of 25% was printed out, and it was ascertained whether or not stripes due to any charge elimination fault appeared after elimination of residual charge of the photosensitive drum 14 effected by the charge eliminating roller 25.

As test conditions, an FS-13200 modified machine (made by KYOCERA Document Solutions Inc.) was used as the image forming apparatus 100, the diameter of the photosensitive drum 14 was set to 30 mm, and the linear velocity was set to 150 mm/sec. As to the charge eliminating roller 25, the diameter of the support member 27 was set to 14 mm, and with regard to Disclosures 1 to 5, the conductive knit fabric 29 being 1.0 mm thick and knitted with use of yarn formed by gathering and twisting a plurality of stainless steel (SUS316L) fibers was used. Further, similar evaluation was performed with use of image forming apparatuses 100 (Comparative Examples 1, 2) including the charge eliminating roller 25 in which the conductive knit fabric 29 was replaced with woven fabric made from copper fibers.

As evaluation criteria for charge elimination performance, a level at which appearance of stripes due to a charge elimination fault was clearly visually discernible was evaluated as Level 1, a level at which appearance of stripes due to a charge elimination fault was visually discernible was evaluated as Level 2, a level at which appearance of stripes due to a charge elimination fault was visually discernible but slightly so was evaluated as Level 3, a level at which appearance of stripes due to a charge elimination fault was present but visually indiscernible was evaluated as Level 4, and a level at which no appearance of stripes due to a charge elimination fault occurred was evaluated as Level 5. Results along with configurations of the charge eliminating roller 25 are shown in Table 1.

TABLE 1

| | Charge eliminating roller | | | | charge eliminating roller-side magnet | | |
|---|---|---|---|---|---|---|---|
| | Material | Fiber dia. (μm) | Conductive Member | Voltage | Present/ absent | Magnetic force (mT) | Charge elimination performance |
| Disclosure 1 | Stainless | 20 | Stationary Knit | Ground | Present | 30 | 3 |
| Disclosure 2 | Stainless | 8 | Stationary Knit | Ground | Present | 30 | 4 |
| Disclosure 3 | Stainless | 20 | Stationary Knit | Ground | Present | 60 | 4 |
| Disclosure 4 | Stainless | 20 | Rotating Knit (*1) | Ground | Present | 30 | 4 |
| Disclosure 5 | Stainless | 20 | Rotating Knit (*1) | Applied (*2) | Present | 30 | 5 |

TABLE 1-continued

| | Charge eliminating roller | | | | | charge eliminating roller-side magnet | | |
|---|---|---|---|---|---|---|---|---|
| | Material | Fiber dia. (μm) | Conductive Member | | Voltage | Present/ absent | Magnetic force (mT) | Charge elimination performance |
| Comp. Ex. 1 | Copper | 8 | Stationary | Woven | Ground | Absent | — | 1 |
| Comp. Ex. 2 | Copper | 8 | Stationary | Woven | Applied (*2) | Present | 60 | 1 |

(*1): Rotating at a linear velocity ratio of 2.0 in a counter direction to the rotational direction of the photosensitive drum
(*2): Applying a DC voltage of a reverse polarity to the surface potential of the photosensitive drum As apparent from Table 1, Disclosures 1 to 5 in which the conductive knit fabric 29 formed by knitting yarn made by twisting together stainless steel fibers was used and in which the charge eliminating roller-side magnet 35 was placed inside the support member 27 resulted, in all cases, in such levels as ranging from slight appearance to no appearance of stripes due to any charge elimination fault. In particular, Disclosure 2 in which the fiber diameter of the stainless steel fiber was as thin as 8 μm, Disclosure 3 in which the magnetic force of the charge eliminating roller-side magnet 35 was as intense as 60 mT, and Disclosure 4 in which the charge eliminating roller 25 was rotated in the counter direction to the photosensitive drum 14, resulted in such levels that appearance of stripes were visually indiscernible. Still more, Disclosure 5 in which the charge eliminating roller 25 was rotated in the counter direction to the photosensitive drum 14 and in which a DC voltage of a reverse polarity to the surface potential of the photosensitive drum 14 was applied resulted in such a suppression level as no appearance of stripes due to any charge elimination fault.

In contrast to this, Comparative Examples 1 and 2 in which woven fabric made from copper fibers was stuck to the support member 27 in place of the conductive knit fabric 29 resulted in appearance of stripes that were clearly visually discernible. In Comparative Example 2, a DC voltage of a reverse polarity to the surface potential of the photosensitive drum 14 was applied to the charge eliminating roller 25, but not enough charge elimination performance was able to be obtained.

Example 2

Charge elimination performance of the charge eliminating roller 25 was evaluated with use of the image forming apparatuses 100 of the fourth to sixth embodiments (Disclosures 6 to 10) including the image forming parts 9 as shown in FIGS. 8 to 10. Further, similar evaluation was performed with use of image forming apparatuses 100 (Comparative Examples 3, 4) including the charge eliminating roller 25 in which woven fabric made from copper fibers was used in place of the conductive knit fabric 29. Test method, test conditions and evaluation criteria were the same as in Example 1, whereas the linear velocity of the photosensitive drum 14 was set to 250 mm/sec, which was faster than in Example 1. Results along with configurations of the charge eliminating roller 25, the charge eliminating roller-side magnet 35, and the drum-side magnet 37 are shown in Table 2.

TABLE 2

| | Charge eliminating roller | | | | | Magnet member | | | |
|---|---|---|---|---|---|---|---|---|---|
| | Material | Fiber dia. (μm) | Conductive Member | | Voltage | Drum side | Charge eliminating roller side | Direction of magnetic pole | Charge elimination Performance |
| Disclosure 6 | Stainless | 20 | Stationary | Knit | Ground | Present | Present | Hetero-polar | 3 |
| Disclosure 7 | Stainless | 8 | Stationary | Knit | Ground | Present | Present | Hetero-polar | 4 |
| Disclosure 8 | Stainless | 8 | Stationary | Knit | Ground | Present | Present | Homo-polar | 3 |
| Disclosure 9 | Stainless | 20 | Rotating (*1) | Knit | Ground | Present | Present | Hetero-polar | 4 |
| Disclosure 10 | Stainless | 20 | Rotating (*1) | Knit | Applied (*2) | Present | Present | Hetero-polar | 5 |
| Comp. Ex. 3 | Copper | 8 | Stationary | Woven | Ground | Absent | Absent | — | 1 |
| Comp. Ex. 4 | Copper | 8 | Stationary | Woven | Applied (*2) | Absent | Absent | — | 1 |

(*1): Rotating at a linear velocity ratio of 2.0 in a counter direction to the rotational direction of the photosensitive drum
(*2): Applying a DC voltage of a reverse polarity to the surface potential of the photosensitive drum As apparent from Table 2, Disclosures 6 to 10 in which the charge eliminating roller-side magnet 35 was placed inside the support member 27 and in which the drum-side magnet 37 was placed inside the photosensitive drum 14 resulted, in all cases, in such levels as ranging from slight appearance to no appearance of stripes due to any charge elimination fault even under the strict condition that the linear velocity of the photosensitive drum 14 was 250 mm/sec. In particular, Disclosure 7 in which the fiber diameter of the stainless steel fiber was as thin as 8 μm and in which the charge eliminating roller-side magnet 35 and the drum-side magnet 37 were set heteropolar in magnetic-pole direction, and Disclosure 9 in which the charge eliminating roller 25 was rotated in the counter direction to the photosensitive drum 14, resulted in such levels that appearance of stripes was visually indiscernible. Still more, Disclosure 10 in which the charge eliminating roller-side magnet 35 and the drum-side magnet 37 were set heteropolar in magnetic-pole direction and in which the charge eliminating roller 25 was rotated in the counter direction to the photosensitive drum 14 and moreover in which a DC voltage of a reverse polarity to the surface potential of the photosensitive drum 14 was applied resulted in such a suppression level as no appearance of stripes due to any charge elimination fault.

In contrast to this, Comparative Examples 3 and 4 in which woven fabric made from copper fibers was stuck to the support member 27 in place of the conductive knit fabric 29 resulted in appearance of stripes that was clearly visually discernible. In Comparative Example 4, a DC voltage of a reverse polarity to the surface potential of the photosensitive drum 14 was applied to the charge eliminating roller 25, but not enough charge elimination performance was able to be obtained.

This disclosure is applicable to discharging members for discharging in noncontact with a discharged member, to charge eliminating devices for eliminating residual charge on an image carrier surface by using the discharging member, and to image forming apparatuses including the charge eliminating device. With use of this disclosure, there can be provide a discharging member capable of fulfilling high-efficiency discharge over long terms even with a low-potential discharged member, as well as a charge eliminating device and an image forming apparatus including the discharging member.

What is claimed is:

1. A discharging member comprising:

an electrically conductive knit fabric which is knitted into a cylindrical shape with use of yarn formed by twisting together a plurality of metal fibers, the electrically conductive knit fabric being stretchable radially;

a support member which is cylindrical shaped with a diameter larger than a diameter of the electrically conductive knit fabric in a state with no external force applied thereto, the support member being inserted in the conductive knit fabric over an entire length thereof while the conductive knit fabric is stretched radially; and a first magnet member which is placed inside the support member, wherein with the conductive knit fabric grounded or with a voltage applied to the conductive knit fabric, the discharging member is placed in noncontact with a discharged member to be discharged in such a fashion that the first magnet member is opposed to the discharged member with the support member and the conductive knit fabric interposed therebetween.

2. The discharging member according to claim 1, wherein the support member is hollow shaped and has an airflow inlet hole formed at one end in its axial direction as well as a plurality of through holes formed in its outer circumferential surface so as to allow an air flow to pass therethrough.

3. The discharging member according to claim 1, wherein the support member is electrically conductive, and the conductive knit fabric is grounded via the support member or allows a voltage to be applied thereto via the support member.

4. The discharging member according to claim 1, wherein the metal fibers have a fiber diameter within a range of 8 μm to 20 μm.

5. A charge eliminating device including the discharging member according to claim 1, wherein a discharge is generated against the discharged member to eliminate charge on the discharged member.

6. An image forming apparatus comprising:

a charge eliminating device including a discharging member, the discharging member comprising:

an electrically conductive knit fabric which is knitted into a cylindrical shape with use of yarn formed by twisting together a plurality of metal fibers;

a support member which is cylindrical shaped and inserted in the conductive knit fabric is stretched radially; and a first magnet member which is placed inside the support member, wherein with the conductive knit fabric grounded or with a voltage applied to the conductive knit fabric, the discharging member is placed in noncontact with a discharged member to be discharged in such a fashion that the first magnet member is opposed to the discharged member with the support member and the conductive knit fabric interposed therebetween;

wherein a discharge is generated against the discharged member to eliminate charge on the discharged member;

an image carrier which, as the discharged member, has a photosensitive layer formed on a surface thereof; and a charging member for charging the photosensitive layer on the image carrier surface, wherein residual charge on the image carrier surface is eliminated by using the charge eliminating device.

7. The image forming apparatus according to claim 6, wherein inside the image carrier, a second magnet member is placed on an inner side of a charge-elimination nip width equal to a width between two tangential lines on an outer circumferential surface of the discharging member parallel to a straight line passing through a rotational center of the image carrier and an axial center of the discharging member.

8. The image forming apparatus according to claim 7, wherein mutually opposed magnetic poles of the first magnet member and the second magnet member are heteropolar to each other.

9. The image forming apparatus according to claim 7, wherein mutually opposed magnetic poles of the first magnet member and the second magnet member are homopolar to each other.

10. The image forming apparatus according to claim 6, wherein a voltage applying device for applying a voltage of a reverse polarity to residual charge on the image carrier surface is connected to the discharging member.

11. The image forming apparatus according to claim 6, wherein the discharging member is rotatable in a counter direction to the image carrier in its surface opposed to the image carrier and moreover variable in linear velocity ratio to the image carrier.

* * * * *